US005217411A

United States Patent [19]

Spector et al.

[11] Patent Number: 5,217,411

[45] Date of Patent: Jun. 8, 1993

[54] MR. SEE SAW

[76] Inventors: George Spector, 233 Broadway-Room 702, New York, N.Y. 10279; Evelyn Holmes, 105-27 171 Pl., Jamaica, N.Y. 11433

[21] Appl. No.: 472,299

[22] Filed: Jan. 30, 1990

Related U.S. Application Data

[63] Continuation-in-part of Ser. No. 262,700, Oct. 26, 1988, abandoned.

[51] Int. Cl.[5] ..... F63G 11/00

[52] U.S. Cl. ..... 472/106; 472/98; 472/101

[58] Field of Search ..... 472/95, 98, 101, 106

[56] References Cited

FOREIGN PATENT DOCUMENTS 3605183 8/1987 Fed. Rep. of Germany ..... 472/106

*Primary Examiner*—Richard E. Chilcot, Jr.

[57] ABSTRACT

A musical seesaw is provided and consists of a music box carried within hollow cylindrical post mounted on a base which is placed on a flat surface. When an elongated plank which is centrally carried between upper ends of a pair of spaced standards extending upwardly from the cylindrical post goes up and down, with a person riding on each end, the music box will operate.

5 Claims, 1 Drawing Sheet

MR. SEE SAW

This application is a continuation-in-part of Ser. No. 262,700 filed Oct. 26, 1988, now abandoned.

BACKGROUND OF THE INVENTION

The instant invention relates generally to seesaws and more specifically it relates to a musical seesaw.

Numerous seesaws have been provided in prior art that are adapted to perform various tasks during the operation of the seesaws. For example, U.S. Pat. Nos. 308,962; 2,874,515 and 3,231,269 all are illustrative of such prior art. While these units may be suitable for the particular purpose to which they address, they would not be as suitable for the purposes of the present invention as heretofore described.

SUMMARY OF THE INVENTION

A primary object of the present invention is to provide a musical seesaw that will overcome the shortcomings of the prior art devices.

Another object is to provide a musical seesaw that will operate a music box when the long plank balanced on a central fulcrum goes up and down.

An additional object is to provide a musical seesaw in which the music box is removable so as to be replaced or repaired when needed.

A further object is to provide a musical seesaw that is simple and easy to use.

A still further object is to provide a musical seesaw that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
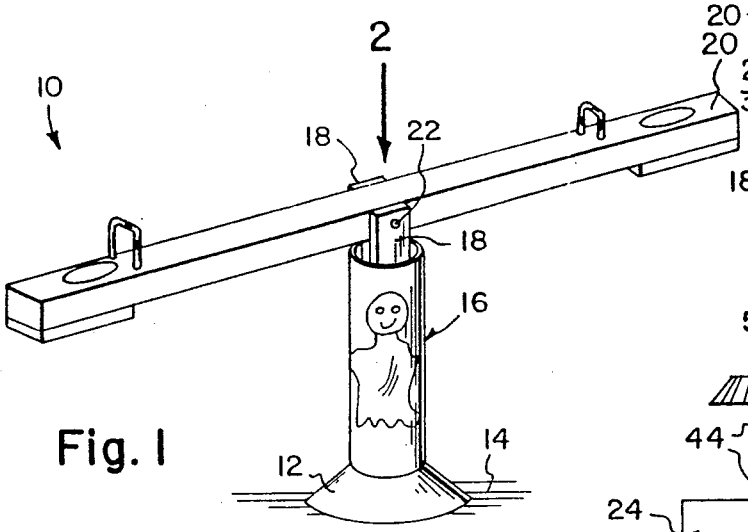
FIG. 1 is a perspective view of the invention showing a cylindrical post.

Turning now descriptively to the drawings, in which similar reference characters denote similar elements throughout the several views, FIGS. 1 through 5 illustrate a musical seesaw 10 containing a base 12 that is placed upon a flat surface 14 while a hollow cylindrical post 16 is mounted on the base 12. A pair of spaced standards 18 are mounted within the cylindrical post 16 with upper ends extending upwardly therefrom and an elongated plank. 20 is centrally carried between the upper ends of the standards 18. A fulcrum pin 22 transversely extends through the upper ends of the standards 18 and center of the plank 20 so that with a person riding on each end of the plank 20, one end will go up as other end goes down. A music box 24 is carried within the cylindrical post 16 and a mechanism 26 causes the music box 24 to operate when ends of the plank 20 go up and down.

Figure 3:
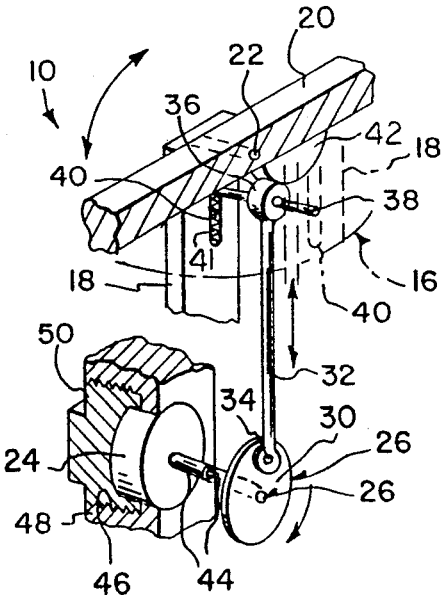
FIG. 3 is a cross sectional perspective view taken along line 3—3 in FIG. 2, showing a music box within the cylindrical post removable through the post wall.
Figure 4:
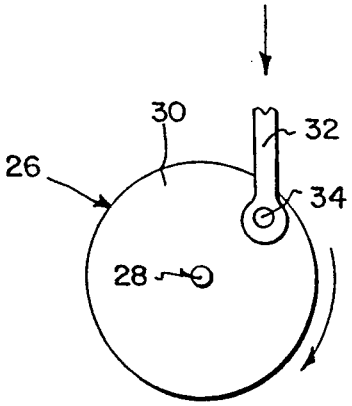
FIG. 4 is an enlarged front view of the drive wheel of FIG. 3.

As shown in FIGS. 3 and 4 the operating mechanism 26 includes a shaft 28 which extends from the music box 24 with a drive wheel 30 connected to end of the shaft 28. An elongated vertical rod 32 is pivotly connected via pivot pin 34 at lower end offset to the drive wheel 30. The rod 32 has a follower 36 at upper end thereof. A guide pin 38 is connected through the follower 36 in a transverse relationship to the rod 32. Each of the standards 18 has an inner vertical slot 40 so that the guide pin 38 can ride up and down therein. A spring 41 is mounted in slot 40 biasing pin 38 upward. A cam 42 is carried on underside of the plank 20 near the fulcrum pin 22 and engages with follower 36 whereby cam 42 pushes follower 36 and pin 38 down on the down stroke and whereby causing the drive wheel 30 to turn and rotate the shaft 28; spring 41 forces pin 38 upward when plank 20 moves upward thus causing continuing rotation of drive wheel 30.

As shown in FIG. 3, the music box 24 is removable from the cylindrical post 16. The shaft 28 is detachable into two rotatable segments 44. The cylindrical post 16 has a threaded aperture 46 in side wall 48 so that the music box 24 can fit into a portion thereof. A removable threaded plug 50 engages with the aperture 46 in the side wall 48 so as to secure the music box 24 when threaded therein and allows for removal of the music box 24 when threaded therefrom.

Figure 5:
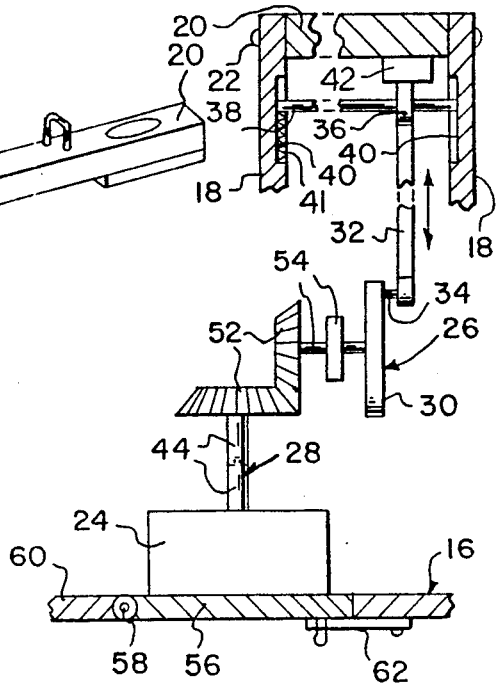
FIG. 5 is a cross section of another modification wherein the music box is replaceable through the post bottom.
Figure 2:
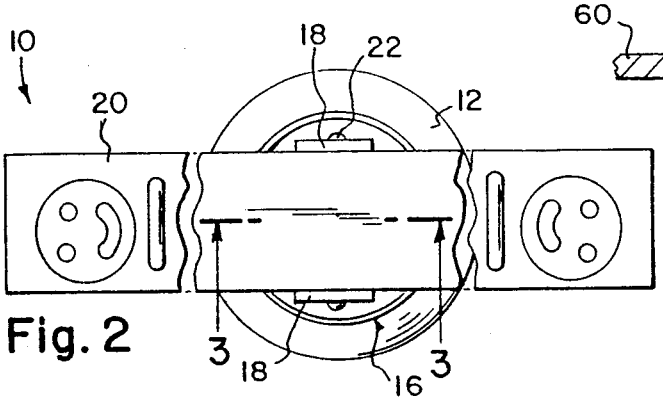
FIG. 2 is a top view taken in direction of arrow 2 in FIG. 1.

As shown in FIG. 5,the operating mechanism 26 is similar to the operating mechanism 26 shown in FIG. 3 except that a pair of mating bevel gears 52 are disposed between the music box 24 and drive wheel 30 so that the shaft 54 on the drive wheel is at a right angle to the shaft 28.

As shown in FIG. 5, the music box 24 is also removable from the cylindrical post 16. The shaft 28 is also detachable into two rotatable segments 44. The cylindrical post 16 has a door 56 hinged at 58 into the bottom wall 60 thereof with the music box 24 carried on top of the door 56 so as to allow removal of the music box 24 when the door 56 is opened. A latch 62 on the bottom wall 60 is for keeping the door 56 closed.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A musical seesaw which comprises:

a) a base placed upon a flat surface;

b) a hollow cylindrical post mounted on said base;

c) a pair of spaced standards having upper ends is mounted within said cylindrical post, said upper ends extending upwardly therefrom;

d) an elongated plank with upper and lower sides and a center mounted between said upper ends of said standards;

e) a fulcrum pin transversely extending through said upper ends of said standards and said center of said plank so that with a person riding on each end of said plank, one end will go up as other end goes down;

f) a musical box carried within said cylindrical post; and g) means for causing said music box to operate when said ends of said plank go up and down.

2. A musical seesaw as recited in claim 1, wherein said operating means includes:

a) a shaft with an end extending from said music box;

b) a drive wheel connected to said end of said shaft;

c) an elongated vertical rod with lower and upper ends being pivotly connected at said lower end offset to said drive wheel, said rod having a follower at said upper end thereof;

d) a guide pin connected through said follower in a transverse relationship to said rod;

e) each of said standards having an inner vertical slot so that said guide pin can ride up and down therein;

f) means mounted on said plank and standard whereby plank movement drives said follower up and down causing said drive wheel to turn and rotate said shaft for operating said music box.

3. A musical seesaw as recited in claim 2, wherein said music box is removable from said cylindrical post and includes:

a) said shaft being detachable into two rotatable segments;

b) said cylindrical post with a side wall having a threaded aperture in said side wall so that said music box can fit into a portion thereof; and c) a removable threaded plug to engage with said aperture in said side wall so as to secure said music box when threaded therein and to allow for removal of said music box when threaded therefrom.

4. A musical seesaw as recited in claim 1, wherein said operating means includes:

a) a first shaft with an end extending from said music box;

b) a first bevel gear connected to said end of said first shaft;

c) a second bevel gear engagable with said first bevel gear;

d) a second shaft having an end extending from said second bevel gear;

e) a drive wheel connected to said end of said second shaft;

f) an elongated vertical rod with lower and upper ends being pivotly connected at said lower end offset to said drive wheel, said rod having a follower at said upper end thereof;

g) a guide pin connected through said follower in a transverse relationship to said rod;

h) each of said standards having an inner vertical slot so that said guide pin can ride up and down therein; and i) means mounted on said plank and standard coacting with said follower and pin causing up and down motion of said follower whereby said drive wheel turns and rotates said shaft for operating said music box.

5. A musical seesaw as recited in claim 4, wherein said music box is removable from said cylindrical post and includes:

a) said shaft being detachable into two rotatable segments;

b) said cylindrical post includes a bottom wall having a door into said bottom wall thereof with said music box carried on said door within said post so as to allow removal of said music box from said post when said door is opened; and c) a latch on said bottom wall for keeping said door closed.

* * * * *

UNITED STATES PATENT AND TRADEMARK OFFICE

CERTIFICATE OF CORRECTION

PATENT NO. : 5,217,411

DATED : June 8, 1993

INVENTOR(S) : Evelyn Holmes et al

It is certified that error appears in the above-indentified patent and that said Letters Patent is hereby corrected as shown below:

On the title page, Item [76]: Inventors should read as follows:

--EVELYN HOLMES, 105-27 171 Place,
Jamaica, NY 11433

GEORGE SPECTOR, 233 Broadway, Room 702
New York, NY 10279--.

Signed and Sealed this

Twenty-eighth Day of December, 1993

*Attest:*

BRUCE LEHMAN

*Attesting Officer*

*Commissioner of Patents and Trademarks*